US010073418B2

(12) United States Patent
Loetscher

(10) Patent No.: US 10,073,418 B2
(45) Date of Patent: Sep. 11, 2018

(54) SUB-ASSEMBLY OF EXTERNAL PARTS FOR WATCH

(71) Applicant: Omega SA, Biel/Bienne (CH)

(72) Inventor: Philippe Loetscher, Evilard (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 15/639,668

(22) Filed: Jun. 30, 2017

(65) Prior Publication Data

US 2018/0011445 A1 Jan. 11, 2018

(30) Foreign Application Priority Data

Jul. 8, 2016 (EP) ..... 16178582

(51) Int. Cl.

| | |
|---|---|
| ***G04B 37/08*** | (2006.01) |
| ***G04B 19/28*** | (2006.01) |
| ***G04B 47/06*** | (2006.01) |

(52) U.S. Cl.

CPC ..... *G04B 37/08* (2013.01); *G04B 19/283* (2013.01); *G04B 47/066* (2013.01)

(58) Field of Classification Search

CPC .... G04B 37/081; G04B 37/08; G04B 37/084; G04B 37/087; G04B 19/283; G04B 47/066

See application file for complete search history.

(56) References Cited

U.S. PATENT DOCUMENTS

| | | | | |
|---|---|---|---|---|
| 3,817,025 A * | 6/1974 | Siegrist | G04B 39/02 | 368/291 |
| 4,184,317 A * | 1/1980 | Kanda | G04B 37/052 | 368/299 |
| 8,777,480 B2 * | 7/2014 | Silvant | G04B 19/286 | 368/295 |
| 8,931,949 B2 * | 1/2015 | Erard | G04B 19/28 | 368/295 |

(Continued)

FOREIGN PATENT DOCUMENTS

| | | |
|---|---|---|
| CH | 665 522 A3 | 5/1988 |
| CH | 703 400 A2 | 1/2012 |

OTHER PUBLICATIONS

European Search Report dated Jan. 16, 2017 in European Application 16178582.9, filed on Jul. 8, 2016 (with English Translation of Categories of cited documents).

*Primary Examiner* — Sean Kayes

(74) *Attorney, Agent, or Firm* — Oblon, McClelland, Maier & Neustadt, L.L.P.

(57) ABSTRACT

Sub-assembly of external parts for a watch, comprising a water-resistant joint between a first and a second component, which are screwed, one on the other, the first component supports a first inclined toothing, which cooperates with a second inclined toothing of the second component, the first component or second component, or a second ring interposed between them comprises a zone which is elastically deformable under the action of a relative rotation between the first and the second component which is caused by an (Continued)

external force, and the deformation range of which allows compression of the elastically deformable zone allowing clearance of the teeth tips during the relative rotation and a release of this zone, allowing return to cooperation of the tips and the hollows of the teeth in a new relative angular position.

13 Claims, 3 Drawing Sheets

(56) References Cited

U.S. PATENT DOCUMENTS

| | | | | |
|---|---|---|---|---|
| 9,395,694 | B1 * | 7/2016 | Wong | G04B 19/286 |
| 9,753,434 | B2 * | 9/2017 | Kobayashi | G04B 19/286 |
| 2007/0147184 | A1 * | 6/2007 | Hiranuma | G04B 37/084<br>368/294 |

* cited by examiner

SUB-ASSEMBLY OF EXTERNAL PARTS FOR WATCH

This application claims priority from European patent application No.16178582.9 of Jul. 8, 2016, the entire disclosure of which is hereby incorporated herein by reference.

FIELD OF THE INVENTION

The invention relates to a sub-assembly of external parts for a watch, comprising at least one water-resistant joint between a first component and a second component which are provided to be screwed one on the other by enclosing each said water-resistant joint in order to form together a water-resistant structure in a water-resistant position of maximum compression of at least one said water-resistant joint according to an axial direction.

The invention also relates to a watch comprising such a sub-assembly of external parts.

BACKGROUND OF THE INVENTION

The external parts of watches and similar apparatus are subject to numerous constraints, in particular with respect to water resistance, sturdiness, appearance, and must be produced so as to avert any involuntary dismantling which is manifested irreparably, by an aftersales intervention for exchanging the water-resistant joints, cleaning, lubrication, or even repair.

Some external parts or control components must, again, be indexed angularly relative to each other for locating the original reference position, the inactive or actuated position, or even for facilitating reading indicators or graduations, or for ensuring the continuity of warped and/or decorative surfaces. This angular indexing is often awkward to produce well, in combination with good tightening of the components and with perfect water resistance of the joints.

Document CH665522G in the name of MONTAVON describes a watch with a rotating bezel which is mounted rotatably about a cylindrical shoulder of a fixed bezel which is part of the case middle of the case. This rotating bezel has an axial shoulder via which it is retained axially on the fixed bezel by an annular axial shoulder of this fixed bezel; it is provided with a serrated toothing which cooperates with pawls which are integral with a fixed ring in order to allow unidirectional rotation of the bezel, and to maintain this rotating bezel manually in the placed position. The toothing of the rotating bezel is a radial toothing formed directly in the rotating bezel, and the pawls of the pawl-supporting ring work radially.

Document CH703400A2 in the name of CARTIER describes a watch case comprising a case middle, a bezel pivoting on the case middle, a retaining member for axial retention, in the direction of the top of the case, the bezel of the case middle and indexing means for defining stable angular positions of the bezel on the case middle. The bezel, the retaining member and the indexing means are provided so that, in normal operation, when it is rotated by the user, the bezel causes the retaining member to rotate with it, whilst being retained axially by the latter. The bezel, the retaining member and the indexing means are likewise provided in order to define unstable angular positions of the bezel on the case middle such that only when the bezel is stopped on one of these unstable angular positions, can the bezel, via a sequence of an axial movement in the direction of the base of the case and of a rotational movement, be displaced relative to the retaining member until being brought into a position where it can be freed axially from the retaining member, and thus dismantled from the case middle.

SUMMARY OF THE INVENTION

The invention proposes producing a water-resistant and secure assembly of external part components with an angular indexing which is easy to regulate and a small increment for adjusting the position in a precise manner.

To this end, the invention relates to a sub-assembly of external parts for a watch according to claim 1.

The invention also relates to a watch comprising such a sub-assembly of external parts.

BRIEF DESCRIPTION OF THE DRAWINGS

Other features and advantages of the invention will be apparent upon reading the detailed description which will follow, with reference to the annexed drawings, in which.

DETAILED DESCRIPTION OF PREFERRED EMBODIMENTS

Figure 1:
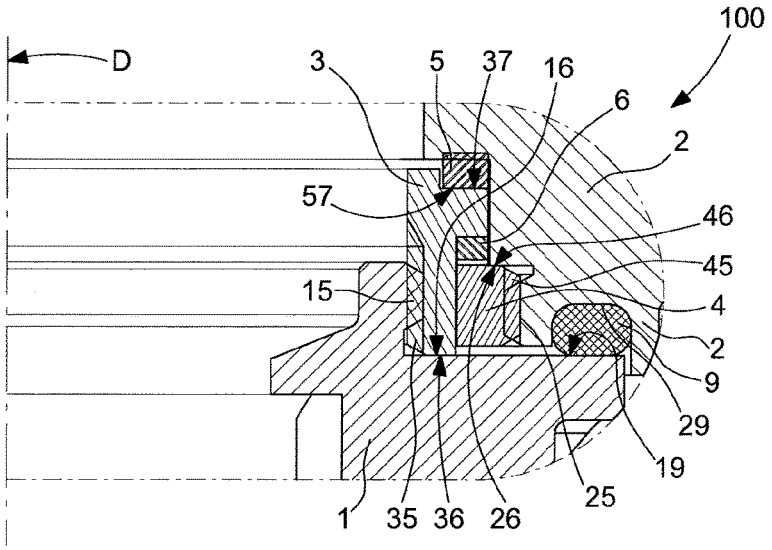
FIG. 1 represents, schematically, partially and in a section, through the axis of its movement, a watch comprising a sub-assembly of external parts according to the invention, comprising a case middle and a base enclosing a water-resistant joint and connected by a mechanism comprising inclined toothings and elastic means, allowing indexing of position, and monodirectional changing of the indexed position.
Figure 2:
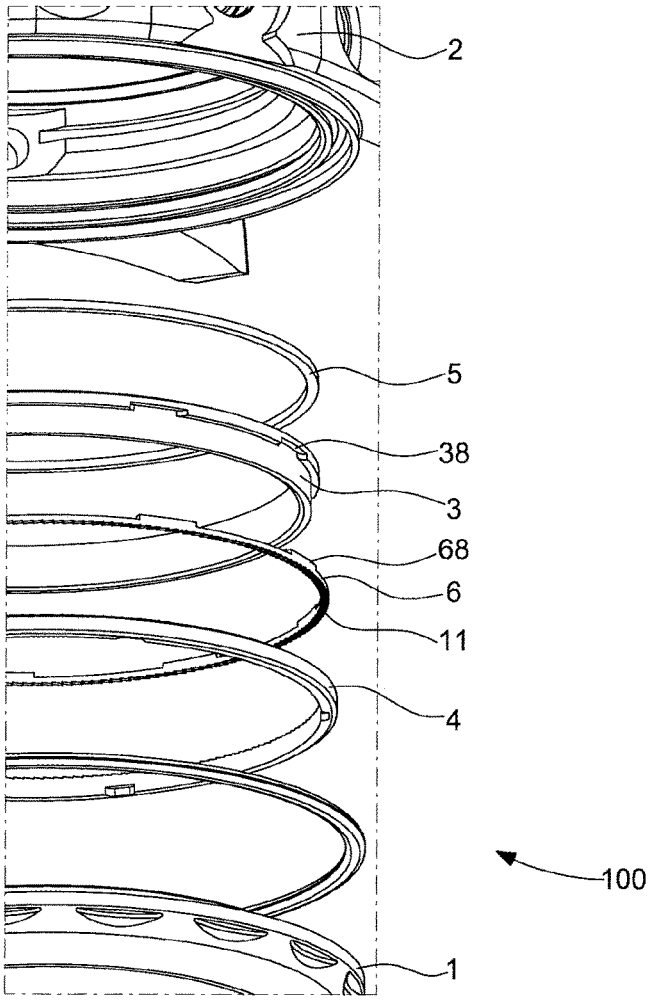
FIG. 2 represents, schematically, partially and in a blown-up perspective, the sub-assembly of external parts of FIG. 1.
Figure 3:
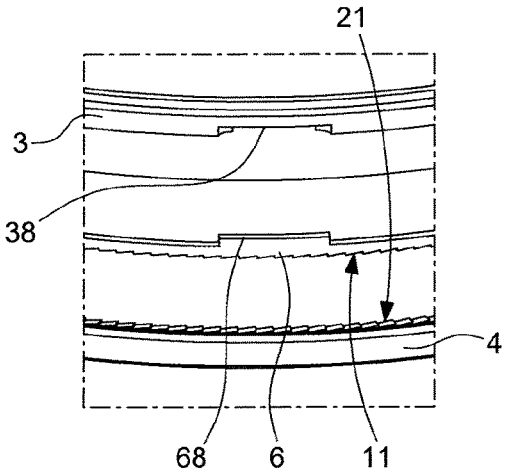
FIG. 3 represents, similarly to FIG. 2, a detail of cooperation between a first strut provided to accommodate a first ring supporting a first inclined toothing orientated towards the bottom, and a second bearing strut of a second inclined toothing orientated towards the top.
Figure 4:
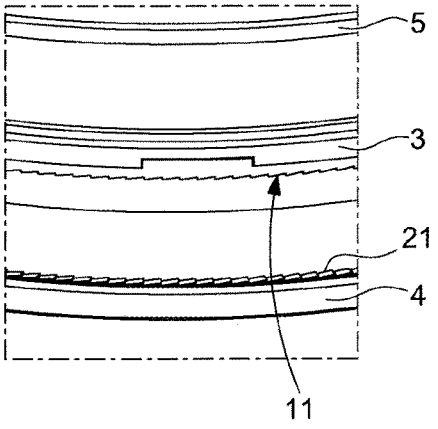
FIG. 4 represents, similarly to FIG. 3, the first ring accommodated in the first strut, one upper annular surface of which is provided to receive a second elastic ring, represented above it.
Figure 5:
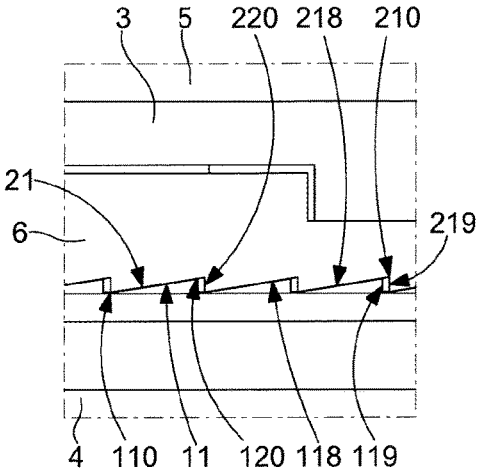
FIG. 5 represents, schematically, partially and in section, the assembly of the components of FIG. 4 in a stable indexed position.
Figure 6:
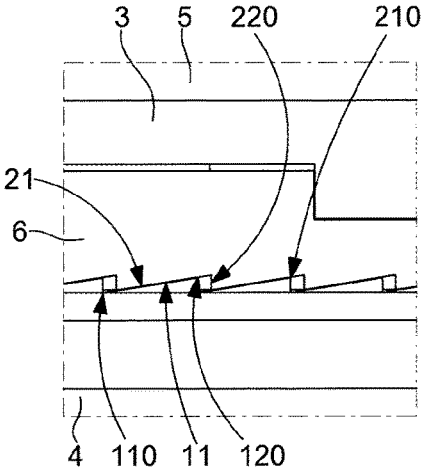
FIG. 6 represents, similarly to FIG. 5, the same components in a transitional position for changing the indexing.
Figure 7:
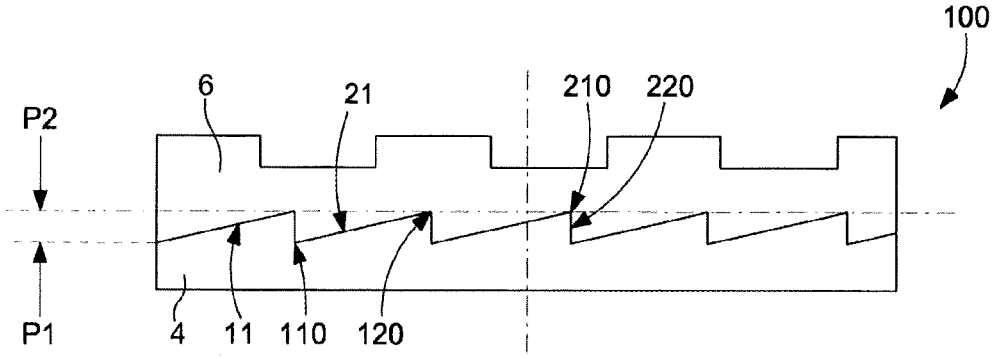
FIG. 7 is a basic diagram, similar to FIG. 5, of inclined toothings for planar cooperation.

The invention proposes producing a water-resistant and secure assembly of external part components with an angular indexing which is easy to control and a small increment for adjusting the relative angular position in a precise manner.

The Figures illustrate the non-limiting example of the angular indexing of a base relative to a watch case middle.

Hence the invention relates to a sub-assembly of external parts 100 for a watch, comprising at least one water-resistant joint 9 between a first component 1 and a second component 2, which are provided to be assembled, in particular screwed, one on the other, by enclosing each water-resistant joint 9 in order to form together a water-resistant structure in a water-resistant position of maximum compression of at least one water-resistant joint 9 according to an axial direction D.

There is understood here by "component", either an elementary component, or else a component amalgamating several elements or elementary components, or even a sub-assembly.

In this water-resistant position, the first component 1 and the second component 2 can no longer be moved one nearer to the other, the water-resistant position corresponding to the maximum compression of a water-resistant joint 9 which is compatible with the physical properties thereof.

According to the invention, the first component 1 supports, directly or indirectly, a first inclined toothing 11, which is provided to cooperate with a second opposite inclined toothing 21 which the second component 2 supports, directly or indirectly.

And the first component 1 and/or the second component 2 and/or a second ring 5 interposed between the first component 1 and the second component 2 comprises at least one zone which is elastically deformable under the action of a relative rotation, about the axial direction D, of the first component 1 relative to the second component 2. This relative rotation is caused by an external force on the sub-assembly of external parts 100, in particular by a torque applied to one of the first 1 and second 2 components relative to the other. The deformation range of this at least one elastically deformable zone is dimensioned to allow its compression during the action of such an external force, with sufficient travel to allow clearance of the teeth tips during the relative rotation of one toothing relative to the other. This deformation range also allows elastic resilience during the release of external force, in order to allow return to complete cooperation of the teeth tips 110, 210 of one of the toothings with the teeth hollows 220, 120 of the other toothing in a new relative angular position.

In brief, application of an external force, in particular a torque, allows clearance of at least one pitch of those of the toothings, the pitch of which is the smallest. In particular, the pitch of the first toothing 11 is identical to the pitch of the second toothing 21, but it could also be a whole multiple or sub-multiple thereof. Each jump of such a pitch corresponds to clearance of the tooth tip. Thanks to the elastic resilience after the jump, the new position reached is stable.

Preferably, the inclined toothings 11 and 21 each comprise, as illustrated in the Figures, alternation of long inclines 118, 218 and steep faces 119, 219, of a slope greater than that of these inclines, or even vertical lines, which are provided to allow integration, in the indexed position, of the first component 1 with the second component 2, in a locked compression position of each water-resistant joint 9, and to counteract relative dismantling without a tool of the first component 1 relative to the second component 2. Dismantling is only possible by using a tool which is adapted for transmission of a torque greater than that which a user is able to impart directly via direct pressure with his bare hand on the first component 1 and the second component 2. In particular, in the preferred application of the invention for indexed integration of a base on a case middle, a notched tool for dismantling the base is indispensable both for precise angular positioning in the desired position and for dismantling of the assembly.

This disposition makes it possible to ensure a reverse lock of the mechanism, counteracting accidental release of the first component 1 and of the second component 2, the relative rotation of which is possible in order to effect relative angular adjustment in a first direction as a condition of applying force thereto, in particular a torque, which is greater than the resistant force formed by combination of the elastic return force and the toothing angle of the elastically deformable zone, but the rotation of which in the opposite direction requires application of a much greater force, in particular in the case of steep faces 119, 219 which are vertical as in the non-limiting variant illustrated by the Figures, or even if inclined toothing profiles which are less steep are chosen with first slope inclines 118, 218 which are less steep than the inclines in the opposite direction, alternately, redescending in the hollows of the teeth.

Various variants for implementation are therefore possible, in particular:

- two opposite elastic toothings, for example made of plastic material or a punched metal sheet, similarly to serrated lockwashers;
- two elastic toothings, one of which supported by an elastic strut;
- two elastic toothings, each supported by an elastic strut;
- one rigid toothing and the other elastic;
- one rigid toothing and the other elastic, one of which is supported by an elastic strut;
- one rigid toothing and the other elastic, each supported by an elastic strut;
- two rigid toothings, one of which is supported by an elastic strut;
- two rigid toothings, each supported by an elastic strut.

The invention is illustrated, in a non-limiting manner, with a single one of these variants, in which the two toothings are each equally elastic or rigid and where a second ring 5 ensures the elasticity function for clearance of the teeth tips and the elastic resilience.

In this particular embodiment, the first component 1 comprises a first strut 3 which supports the first inclined toothing 11, and the second component 2 comprises a second strut 4 which supports the second inclined toothing 21. The converse alternatives are not described here, the person skilled in the art will have no difficulty in exchanging the functions of the various components of the sub-assembly of external parts 100 according to the invention.

More particularly, this first component 1 comprises a first strut 3, and comprises a first thread 15 which is provided to cooperate with a first complementary thread 35 which this first strut 3 comprises. The first component 1 also comprises a first axial stop support surface 16 which is provided to cooperate as a stop support with a first complementary axial stop support surface 36 which the first strut 3 comprises.

More particularly, the first component 1 comprises a first strut 3, and comprises a first ring 6 comprising the first inclined toothing 11, this first strut 3 comprising first actuation means 38 provided to cooperate with first complementary actuation means 68 which the first ring 6 comprises.

In a particular embodiment, the first strut 3 and the second ring 6 form a monobloc component.

Similarly, in a particular embodiment, the second component 2 comprises a second strut 4 and comprises a second thread 25 which is provided to cooperate with a second complementary thread 45 which the second strut 4 comprises. This second component 2 comprises a second axial stop support surface 26 which is provided to cooperate as stop support with a second complementary axial stop support surface 46 which the second strut 4 comprises.

More particularly, the sub-assembly of external parts 100 comprises a second ring 5 which is interposed between the first component 1 and second component 2 and which comprises at least one elastically deformable zone. More particularly, this second ring 5 is produced entirely in an elastically deformable material. This second ring 5 is supported by a contact surface 57 which it comprises, over a complementary contact surface 37 which the first strut 3 comprises.

The functioning is particularly simple. It is necessary first of all to screw the first component 1 and to lock it and then follows the angular indexing.

The second strut 4 is fixed, preferably by screwing, as in the illustrated embodiment, to the second component 2. The first strut 3 and the first ring 6 are enclosed, sandwiched between the first ring 5 and the second strut 4. The first ring 5 can be made of silicone or another elastic material, it is compressed between the second component 2 and the first strut 3. The first strut 3 is retained between the second ring 5, the first strut 3 and the second strut 4.

The first ring 6 and the second strut 4 are provided respectively with the first toothing 11 and with the second toothing 21. The number of teeth determines the precision of the positioning of the orientatable element, here the first component 1, in particular a base, if the second component 2, in particular a case middle, is regarded as fixed. An embodiment with 180 teeth hence allows precision of two degrees.

The first toothing 11 and the second toothing 21 make it possible, by the effect of the pawl, due to the elasticity of the second ring 5, for the first strut 3 and for the first ring 6 to turn relative to each other in a single direction, the system is therefore unidirectional.

The first component 1 comes to be screwed into the first strut 3. Once the first strut 3 is in a stop position on the first component 1, via cooperation of the stopping of the first complementary axial stop support surface 36 and of the first axial stop support surface 16, the two parts become integral, and the water-resistant joint 9 is placed and compressed in its housing 29 of the second component 2 and on the joint stop surface 19 of the first component. The various cooperations for stopping of the mechanism between the first component 1 and the first strut 3, on the one hand, and between the second component 2 and the second strut 4, on the other hand, make it possible inter alia to ensure a maximum level of compression of this water-resistant joint 9.

If the operator continues to apply a torque on the first component 1 in order to make it turn, the first component 1 and the first strut 3 and the first ring 5, forming an integral mounting, begin to slide over the inclines acting as pawls of the second strut 4 which allows axial positioning of the first component 1.

For dismantling, it suffices to unscrew the first component 1. Thanks to the toothings of the first ring 6 and of the second strut 4, the latter come to be locked one against the other, and become integral with the second component 2, and the first component 1 can be unscrewed.

In the particular embodiment illustrated by FIGS. 1 to 7, the first inclined toothing 11 and the second inclined toothing 21 comprise teeth tips which define a first plane P1 and respectively a second plane P2 perpendicular to the axial direction D.

Figure 8:
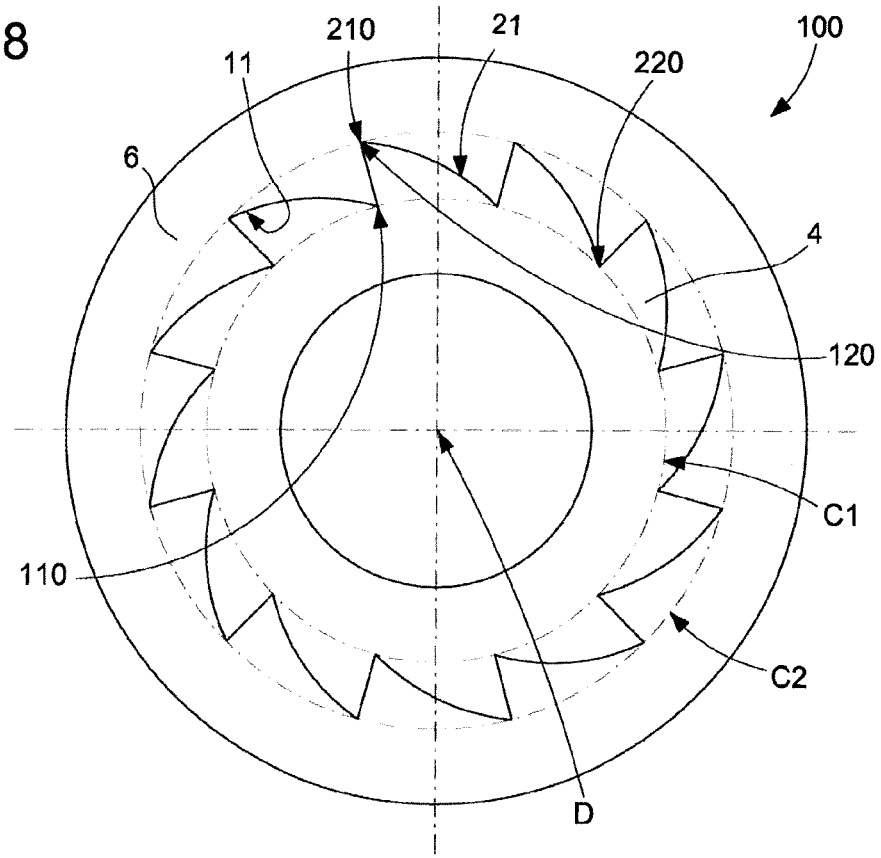
FIG. 8 is a basic diagram, viewed from above, of inclined toothings for cylindrical cooperation.

In another schematic embodiment in FIG. 8, the components comprising the teeth are coaxial, and the first inclined toothing 11 and the second inclined toothing 21 comprise teeth tips which define a first cylinder C1 and respectively a second cylinder C2 which are coaxial and parallel to the axial direction D.

In a particular application illustrated in FIGS. 1 to 6, the first component 1 is a base and the second component 2 is a watch case middle. Of course the converse configuration is also perfectly achievable.

In another application, the first component 1 is a case middle and the second component 2 is a raised portion or a fixed bezel. This variant is of interest for diving watches comprising furthermore a unidirectional bezel.

In yet another application, the first component 1 is a case middle or a tube mounted on a case middle and the second component 2 is a ring support.

The invention likewise relates to a watch 1000 comprising such a sub-assembly of external parts 100.

In brief, the invention allows precise angular adjustment between two components of the external parts of a watch or even of a scientific apparatus which can be integrated in a watch by its external part structure, the angular adjustment precision being given by the smallest pitch of the inclined toothings which the sub-assembly of external parts according to the invention comprises.

The invention ensures perfect clamping of the water-resistant joint between the first and the second components.

The invention is also resistant to a relative angular mismatch and to accidental and involuntary dismantling of the assembly of the two components, because its design requires application of a force which is much greater for dismantling than for assembly.

The invention claimed is:

1. A Sub-assembly of external parts for a watch, comprising at least one water-resistant joint between a first component and a second component, which are provided to be screwed, one on the other, by enclosing each said water-resistant joint in order to form together a water-resistant structure in a water-resistant position of maximum compression of at least one said water-resistant joint according to an axial direction, wherein said first component supports a first inclined toothing, which is provided to cooperate with a second opposite inclined toothing which said second component supports, and wherein said first component and/or said second component and/or a second ring interposed between said first component and said second component comprises at least one zone which is elastically deformable under action of a relative rotation, about said axial direction, of said first component relative to said second component which is caused by an external force on said sub-assembly of external parts, and deformation range of which is dimensioned to allow compression of said at least one elastically deformable zone during the action of said external force allowing clearance of teeth tips during said relative rotation and, upon release of the external force, allowing return to complete cooperation of the teeth tips of one of the toothings with teeth hollows of the other toothing in a new relative angular position, said first inclined toothing and second inclined toothing each comprising an alternation of long inclines and steep faces, of a slope greater than that of said inclines, and which are provided to allow integration, in an indexed position, of said first component with said second component, and to counteract angular mismatch thereof without a tool and the relative dismantling thereof without a tool.

2. The Sub-assembly of external parts according to claim 1, wherein said first component and said second component each comprise at least one zone which is elastically deformable under the action of a relative rotation, about said axial direction, of said first component relative to said second component which is caused by an external force on said sub-assembly of external parts.

3. The Sub-assembly of external parts according to claim 1, wherein said first component comprises a first strut which supports said first inclined toothing, and said second component comprises a second strut which supports said second inclined toothing or conversely.

4. The Sub-assembly of external parts according to claim 3, wherein said first component comprises one said first strut, and comprises a first thread which is provided to cooperate with a first complementary thread which said first strut comprises, and a first axial stop support surface which is provided to cooperate as a stop support with a first complementary axial stop support surface which said first strut comprises.

5. The Sub-assembly of external parts according to claim 3, wherein said first component comprises one said first strut, and comprises a first ring comprising said first inclined toothing, said first strut comprising first actuation means provided to cooperate with the first complementary actuation means which said first ring comprises.

6. The Sub-assembly of external parts according to claim 3, wherein said second component comprises one said second strut and comprises a second thread which is provided to cooperate with a second complementary thread which said second strut comprises, and a second axial stop support surface which is provided to cooperate as stop support with a second complementary axial stop support surface which said second strut comprises.

7. The Sub-assembly of external parts according to claim 1, wherein it comprises one said second ring which is interposed between said first component and said second component and which comprises at least one said elastically deformable zone.

8. The Sub-assembly of external parts according to claim 1, wherein said first inclined toothing and said second inclined toothing comprise teeth tips which define a first plane and respectively a second plane perpendicular to said axial direction.

9. The Sub-assembly of external parts according to claim 1, wherein said first inclined toothing and said second inclined toothing comprise teeth tips which define a first cylinder and respectively a second cylinder which are coaxial and parallel to said axial direction.

10. The Sub-assembly of external parts according to claim 1, wherein said first component is a base and said second component is a case middle or conversely.

11. The Sub-assembly of external parts according to claim 1, wherein said first component is a case middle and said second component is a raised portion or a fixed bezel.

12. The Sub-assembly of external parts according to claim 1, wherein said first component is a case middle or a tube mounted on a case middle and said second component is a ring support.

13. A Watch comprising a sub-assembly of external parts according to claim 1.

* * * * *